US006481185B1

(12) United States Patent
Buchko

(10) Patent No.: US 6,481,185 B1
(45) Date of Patent: Nov. 19, 2002

(54) SYSTEM FOR MODIFYING THE ATMOSPHERE WITHIN THE INTERIOR OF A PACKAGE

(76) Inventor: Raymond G. Buchko, 1150 Symphony Blvd., Neenah, WI (US) 54956

( * ) Notice: Subject to any disclaimer, the term of this patent is extended or adjusted under 35 U.S.C. 154(b) by 61 days.

(21) Appl. No.: 09/698,741

(22) Filed: Oct. 27, 2000

Related U.S. Application Data

(63) Continuation-in-part of application No. 08/782,775, filed on Jan. 13, 1997, now Pat. No. 5,989,613.
(60) Provisional application No. 60/162,010, filed on Oct. 27, 1999.

(51) Int. Cl.[7] ..... B65B 31/04
(52) U.S. Cl. ..... 53/432; 53/468; 53/510; 53/381.2
(58) Field of Search ..... 53/412, 432–434, 53/492, 510–512, 133.1, 468, 381.2

(56) References Cited

U.S. PATENT DOCUMENTS

| | | | |
|---|---|---|---|
| 2,361,344 | A | 10/1944 | Yates |
| 2,387,812 | A | 10/1945 | Sonneborn et al. |
| 2,542,206 | A | 2/1951 | Nichols |
| 2,863,267 | A | 12/1958 | Moore |
| 3,360,382 | A | 12/1967 | Miller |
| 3,407,078 | A | 10/1968 | Schlichter |

(List continued on next page.)

FOREIGN PATENT DOCUMENTS

| | | |
|---|---|---|
| EP | 0597097 A1 | 5/1994 |
| FR | 1408217 | 5/1964 |
| JP | 52-591 | 5/1977 |
| JP | 54-148690 | 11/1979 |
| JP | 03240615 | 10/1991 |
| JP | 4-242-572 | 8/1992 |

*Primary Examiner*—Stephen F. Gerrity
(74) *Attorney, Agent, or Firm*—Boyle, Frederickson, Newholm, Stein & Gratz, S.C.

(57) ABSTRACT

A system for packaging of perishable food products involves initially packaging the food product in a receptacle containing an inert gas atmosphere and sealing a film to the receptacle. The inert gas atmosphere prevents deterioration of the food product subsequent to shipment from a central processing facility. The receptacle includes a sealing flange and a tab portion extending from the sealing flange, to which the film is sealed. To prepare the food product for display at a retail establishment, the tab and the film sealed thereto are removed from the package, by operation of a severing mechanism, to form an opening between the film and the receptacle. An atmosphere exchange operation is carried out through the opening, by injecting gas through the opening into the receptacle cavity. The severing mechanism includes a knife member, and gas is injected into the opening through a gas injection port formed in the knife member. The inert gas atmosphere initially contained within the receptacle is exhausted through the opening. Once the atmosphere exchange process has been carried out, the opening is closed by sealing the film to the receptacle by operation of a sealing mechanism. Introduction of the oxygen-containing gas into the receptacle cavity induces the desired oxygen "bloom" in a fresh meat food product, and in other food products replaces the inert gas atmosphere in preparation for display and consumption of the food product. The final configuration of the package as displayed to consumers has the same external appearance as prior art packages, leading to ready consumer acceptance while greatly enhancing product life and reducing spoilage associated with production and distribution of the food products from a central processing facility.

38 Claims, 8 Drawing Sheets

U.S. PATENT DOCUMENTS

| | | | | |
|---|---|---|---|---|
| 3,490,576 | A | | 1/1970 | Alessi et al. |
| 3,512,632 | A | | 5/1970 | Wiggins |
| 3,659,393 | A | | 5/1972 | Richter |
| 3,735,551 | A | | 5/1973 | Pratt |
| 4,055,672 | A | | 10/1977 | Hirsch et al. |
| 4,162,599 | A | | 7/1979 | Kyle |
| 4,409,252 | A | | 10/1983 | Buschkens et al. |
| 4,581,764 | A | | 4/1986 | Pluck et al. |
| 4,581,874 | A | | 4/1986 | Rechtsteiner et al. |
| 4,589,145 | A | | 5/1986 | Van Erden |
| 4,754,596 | A | | 7/1988 | Yasumune et al. |
| 4,896,479 | A | | 1/1990 | Gannon |
| 4,919,955 | A | | 4/1990 | Mitchell |
| 4,920,726 | A | * | 5/1990 | Yamada et al. ..... 53/512 |
| 5,271,207 | A | | 12/1993 | Epstein et al. |
| 5,445,838 | A | | 8/1995 | Lipinski et al. |
| 5,481,852 | A | | 1/1996 | Mitchell |
| 5,711,978 | A | | 1/1998 | Breen et al. |
| 5,989,613 | A | | 11/1999 | Buchko |

* cited by examiner

FIG. 5
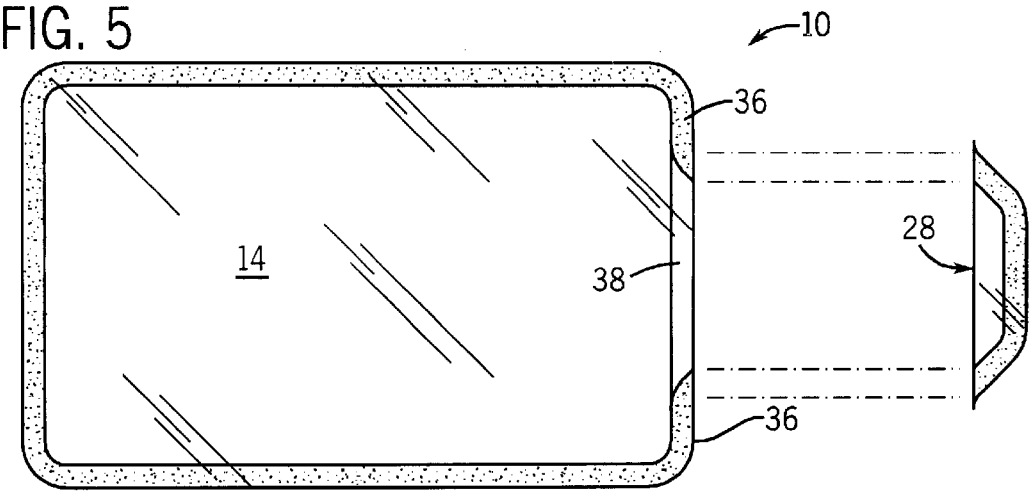
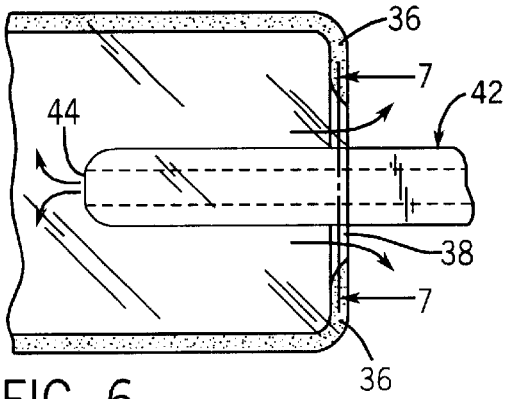
FIG. 6
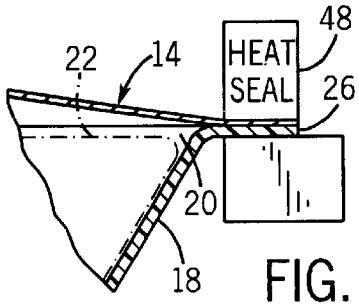
FIG. 8
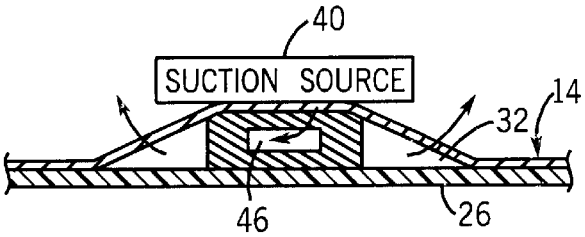
FIG. 7
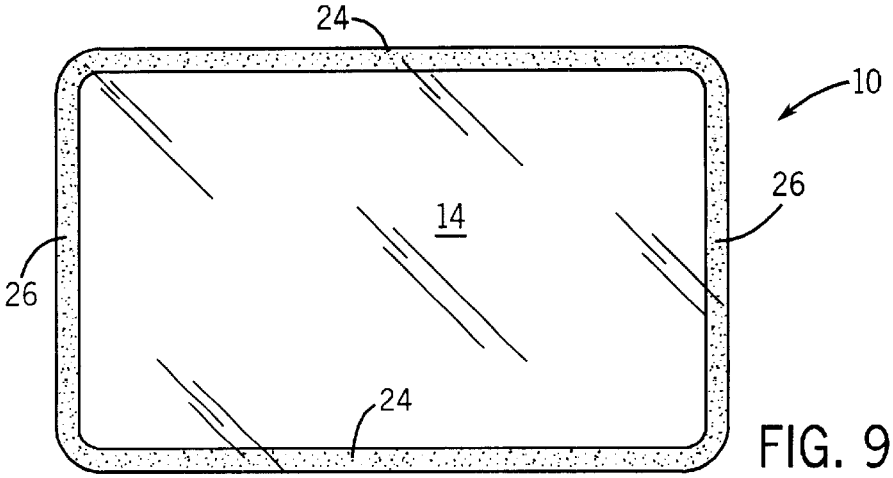
FIG. 9

FIG. 11A
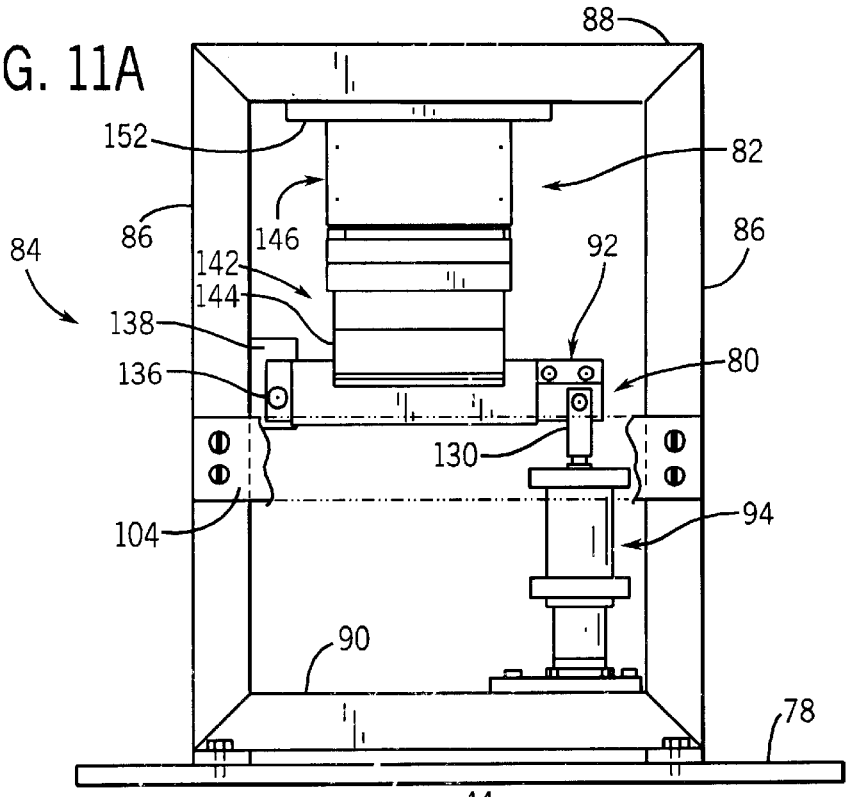
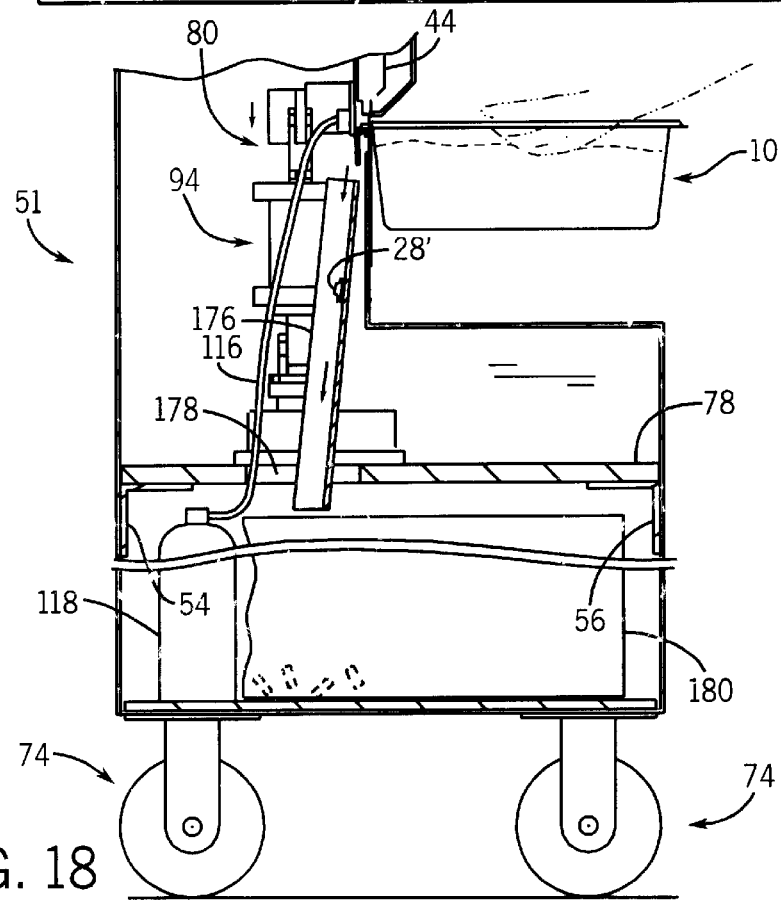
FIG. 18

SYSTEM FOR MODIFYING THE ATMOSPHERE WITHIN THE INTERIOR OF A PACKAGE

CROSS REFERENCE TO RELATED APPLICATION

This application is a continuation-in-part of application Ser. No. 08/782,775 filed Jan. 13, 1997, now U.S. Pat. 5,989,613, and claims the benefit of provisional Application Serial No. 60/162,010 filed Oct. 27, 1999.

BACKGROUND AND SUMMARY OF THE INVENTION

This invention relates to packaging, and more particularly to packaging of perishable food products.

In packaging of fresh red meat products, it is known to initially cut and package the meat products at a processing facility for subsequent shipment to retail outlets. Typically, the meat products are packaged such that ambient air is contained within the package, which can result in discoloration of the meat product caused by conversion of myoglobin meat pigment to a grayish or brownish metmyoglobin. This discoloration generally renders the meat product unacceptable for consumers. Ultimately, such exposure to ambient air can result in spoilage of the meat product.

In order to avoid discoloration and spoilage of meat products and to provide a desirable aging of the meat product, it is known to vacuum package the meat product to remove ambient air and any other atmosphere from the package. It is also known to package the meat product in an inert gas atmosphere, such as a nitrogen gas atmosphere.

Vacuum packaging of meat products is less than optimal for several reasons. First, vacuum packaging is a relatively expensive process requiring specialized equipment. Secondly, vacuum packaging produces an end product in which the film wrap material is in contact with the meat product, resulting in an irregularly shaped package which is undesirable from the standpoint of product presentation. Further, vacuum packaged meat products do not have the deep red color desired by consumers.

Packaging fresh meat products with an inert gas atmosphere has been found to be an acceptable way to preserve the meat product and provide a desirable aging, after shipment of the meat product from a processing facility to a retail outlet. However, once the package has arrived at the retail outlet, it is necessary to replace the inert gas atmosphere within the package with an oxygen-containing atmosphere. This removes any discoloration on the surface of the meat product which may have been caused by the presence of the inert gas atmosphere, and produces the desired oxygen "bloom" which results in the desirable deep red color on the surface of the meat product.

U.S. Pat. 4,055,672 issued Oct. 25, 1977 discloses a system in which a meat product is packaged within a package in which one of the package walls is formed from a gas impermeable material and another package wall is formed of an inner gas permeable layer and an outer gas impermeable layer. The meat product is initially packaged in an inert gas atmosphere, which is maintained within the package by the package walls including the outer gas impermeable wall layer. When it is desired to display the meat product for purchase by a consumer, the outer gas impermeable layer is removed, which enables oxygen-containing ambient air to flow into the package through the gas permeable layer. This results in the desired oxygen bloom in preparation for display. This system is disadvantageous in that deterioration of the product is not prevented after the impermeable layer has been removed, unless an additional impermeable layer is subsequently added to the package. In addition, it is necessary to add an impermeable layer over the permeable layer if the product is to be frozen. Further, the required combination of a gas impermeable film layer overlying a gas permeable film layer is difficult and expensive to produce, and difficult to seal to the container in a manner providing satisfactory removal of the gas impermeable layer.

U.S. Pat. 4,919,955 issued Apr. 24, 1990, discloses a packaging system in which a septum valve is incorporated into the wall of a tray in which the meat product is packaged. A hollow needle is inserted through the septum valve and is interconnected with an atmosphere exchange device, which functions to remove the inert gas atmosphere from the interior of the package and replace it with an oxygen-containing atmosphere, to induce the desired oxygen bloom in the meat product. After the atmosphere within the package is exchanged, the hollow needle is removed and the septum valve closes to maintain the oxygen-containing atmosphere within the package. Again, this system is functional to replace an inert gas atmosphere with an oxygen-containing atmosphere in the interior of a package. However, the septum valve provides a point of entry for possible tampering with the package contents while the package is on display, which would not leave any trace of tampering on the package itself. Further, the hollow needle terminates in a sharp end which could give rise to hazardous conditions for the operator of the atmosphere exchange device.

It is an object of the present invention to provide a packaging system for perishable products in which an inert gas atmosphere within the interior of the package can be easily and quickly replaced with an oxygen-containing atmosphere. It is a further object of the invention to provide such a packaging system in which the final package is identical in appearance to prior art packages from a consumer standpoint. It is a further object of the invention to provide such a packaging system in which the packaged product can be frozen without having to add an additional layer of wrap material to the package. Yet another object of the invention is to provide such a packaging system in which the atmosphere within the package interior is replaced using an oxygen-containing atmosphere delivery apparatus which does not present the potential for harm to an operator. A still further object of the invention is to provide such a packaging system in which the final package configuration is not susceptible to undetectable tampering.

In accordance with one aspect of the invention, an atmosphere exchange method is provided for a perishable food product package in which the food product is disposed within a receptacle having an internal cavity and an inert gas atmosphere is contained within the receptacle cavity, and in which a substantially impermeable film is sealed to the receptacle to maintain the inert gas atmosphere within the receptacle cavity. The atmosphere exchange method of the invention involves forming an opening in a portion of the seal between the film and the receptacle, replacing the inert gas atmosphere within the receptacle cavity, through the opening, with a non-inert gas atmosphere, and sealing the film to the receptacle to close the opening and to maintain the non-inert gas atmosphere within the receptacle cavity. The receptacle preferably includes a side wall having an upper surface including a lateral projection. The step of forming the opening in the seal between the film and the receptacle is carried out by first sealing the film to an outer portion of the lateral projection while leaving an inner portion of the lateral projection unsealed, and subsequently removing at least the outer portion of the lateral projection such that the opening is formed between the film and the inner unsealed portion of the lateral projection. The upper surface of the receptacle side wall is sealed to the film on either side of the lateral projection to define a pair of aligned spaced sealed areas, and the step of removing at least the outer portion of the lateral projection is carried out such that the opening is located between the pair of aligned, spaced sealed areas. The step of replacing the inert gas atmosphere within the receptacle cavity is carried out by separating the film from the side wall upper surface at the unsealed area to form the opening, and introducing the non-inert gas atmosphere into the receptacle cavity interiorly of the opening and simultaneously enabling the inert gas to escape the receptacle cavity through the opening. The step of introducing the non-inert gas atmosphere into the receptacle cavity is carried out utilizing a nozzle having a discharge area, and inserting the nozzle through the opening such that the nozzle discharge area is disposed interiorly of the opening and in communication with the receptacle cavity. The nozzle occupies less than the entire area of the opening, such that the unoccupied portion of the opening creates an outlet passage establishing communication between the receptacle cavity and the exterior of the receptacle for allowing the inert gas atmosphere to escape from the package interior upon introduction of the inert gas atmosphere. The step of separating the film from the side wall upper surface at the unsealed area is carried out by stretching the film between the spaced sealed areas to allow the nozzle to pass through the opening. The film at the unsealed area then returns to its original, unstretched condition subsequent to removal of the nozzle, and the step of sealing the film to the receptacle to close the opening is carried out by sealing the film to the receptacle at the previously unsealed area between the sealed areas. With this arrangement, the atmosphere within the package is exchanged and the package has the external appearance of any conventional fresh meat product packaged within a tray-type receptacle having an impermeable film overwrap sealed thereto.

In accordance with another aspect of the invention, a package for use in packaging a perishable food product is in the form of a receptacle defining an internal cavity and having a peripheral sealing surface, and a film sealed to the peripheral sealing surface. The receptacle includes a tab portion, and the peripheral sealing surface includes a non-linear segment in which the film is sealed to the tab portion. The receptacle further includes a sealing area located inwardly of the non-linear segment of the sealing surface and substantially coplanar with spaced portions of the sealing surface on either side of the non-linear segment. With this construction, the tab and the film secured to the non-linear segment can be removed to create an unsealed area between the film and the receptacle for use in exchanging the atmosphere within the receptacle cavity. After the atmosphere has been exchanged, the film is sealed to the sealing area to close the opening. The sealing area extends substantially linearly between the spaced portions of the sealing surface on either side of the non-linear segment. The receptacle preferably has a series of side walls extending upwardly from a bottom wall, and each side wall includes a sealing flange located at its upper end. The tab extends outwardly from the sealing flange of one of the side walls, such that the peripheral sealing surface is defined by the sealing flanges in combination with the tab. The tab is preferably in the form of a planar extension of one of the sealing flanges, and preferably has a length less than the length of the sealing flange from which it extends. The sealing flange on either side of the tab defines the spaced linear segments of the peripheral sealing surface between which the non-linear segment is located. In a preferred form, the sealing flange and the tab are configured such that removal of the tab between the spaced linear segments of the peripheral sealing surface results in a sealing flange substantially identical in configuration to a sealing flange associated with at least one other side wall of the receptacle.

In accordance with another aspect of the invention, a receptacle for use in packaging a perishable food product includes a bottom wall and a series of side walls extending upwardly therefrom to define an internal cavity for receiving the perishable food product. The upstanding side walls define a peripheral sealing surface adapted to have a film sealed thereto for closing the internal cavity. At least at first one of the side walls includes a lateral projection having an outer edge defining a portion of the sealing surface and an inner area substantially coplanar with the outer edge and with spaced portions of the sealing surface adjacent the lateral projection. The first side wall includes a sealing flange defining a portion of the peripheral sealing surface, and the lateral projection extends from the sealing flange and is substantially coplanar therewith. The first side wall and its associated sealing flange have a length greater than that of the lateral projection.

The invention further contemplates a system for modifying a gas atmosphere within the interior of a package which includes a receptacle defining an interior and having a sealing area, and a film sealed to the sealing area for closing the package to maintain a first gas atmosphere within the package interior. The system incorporates a severing member for severing a portion of the receptacle sealing area and the film sealed thereto from the remainder of the receptacle sealing area and film, such that severing of the portion of the receptacle sealing area and the film sealed thereto is operable to form an opening between the film and the remainder of the receptacle sealing area. The gas atmosphere modification system includes a pressurized gas introduction system including a gas injection port. The package is adapted for positioning after operation of the severing member such that the opening is located adjacent the gas injection port. The pressurized gas introduction system is operable to discharge a gas from the gas injection port through the opening into the package interior, to modify the atmosphere therewithin. At least a portion of the first gas atmosphere escapes from the package interior through the opening upon passage of gas from the gas injection port, to create a second gas atmosphere within the package interior modified from the first gas atmosphere by the injection of the gas into the package interior. The gas atmosphere modification system further includes a sealing member for sealing the film to the receptacle sealing area at the opening, to close the package and to maintain the second gas atmosphere within the package interior. The severing member is preferably in the form of a knife member movable relative to a stationary support member which is adapted to support the receptacle adjacent the sealing area. The gas injection port may be in the form of an opening formed in the knife member to which pressurized gas from the pressurized gas introduction system is supplied for passage into the opening. The knife member is movable from an inoperative, retracted position to an operative, severing position. When the knife member is in its severing position, the gas injection port is aligned with the opening providing access to the interior of the package, such that operation of the pressurized gas introduction system forces gas through the gas injection port and the opening into the package interior. The knife member may be mounted to an extendible and retractable cylinder assembly for movement between its retracted position and its severing position. The knife member may be in the form of a knife blade mounted to a knife support member, which defines a passage establishing communication with the gas injection port in the knife member. The pressurized gas supply system may include a flexible hose interconnected with the knife support member and movable therewith, for providing pressurized gas from a gas supply source to the passage in the knife support member. The sealing member may be in the form of a movable seal bar located adjacent the knife member, for selective movement into engagement with the film to seal the film to the receptacle sealing area. The gas atmosphere modification system is preferably contained within a housing which defines a passage for receiving the portion of the receptacle sealing area to be severed, with the remainder of the package being maintained exteriorly of the housing. The housing further includes a bin or the like for receiving the severed portions of the receptacle sealing areas and the film sealed thereto subsequent to severing from the remainder of the package.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 5 is a view similar to FIG. 3, showing removal of the tab in order to form an opening between the film and the receptacle;

FIG. 6 is a top plan view of a portion of the package of FIG. 5, showing an atmosphere exchange nozzle inserted through the opening;

FIG. 7 is a partial section view taken along line 7—7 of FIG. 6;

FIG. 8 is a partial section view showing resealing the opening in the package of FIG. 7 after removal of the atmosphere exchange nozzle;

FIG. 9 is a top plan view of the package of FIG. 1 showing the end result of the method illustrated in FIGS. 5–8;

FIG. 11A is a partial section view taken along line 11A—11A of FIG. 10;

FIG. 12A is a top plan view of the package as engaged with the gas atmosphere modification apparatus of FIGS. 10 and 11, with reference to line 12A—12A of FIG. 12;

FIG. 18 is a partial section view taken along line 18—18 of FIG. 11.

DETAILED DESCRIPTION OF THE INVENTION

Figure 1:
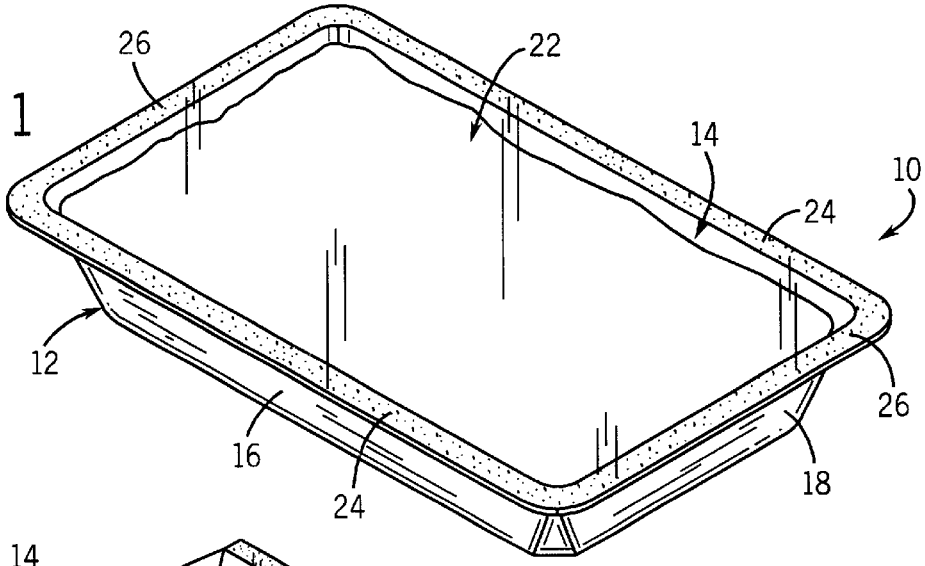
FIG. 1 is an isometric view of a perishable food product package resulting from the packaging system of the invention, incorporating a tray-type receptacle and an impermeable film secured thereto.

With reference to FIGS. 1 and 9, a package 10 for a perishable food product generally includes a tray-type receptacle 12 having an impermeable film 14 sealed thereto. Receptacle 12 includes a bottom wall having a pair of spaced side walls 16 and a pair of spaced end walls 18 extending upwardly therefrom. Side walls 16 and end walls 18 are interconnected with each other and cooperate with the bottom wall of receptacle 12 to define an internal cavity 20 within which a perishable food product 22 is placed. Food product 22 may be any perishable food product subject to deterioration upon exposure to ambient air, such as meat, cheese, fruit or vegetable products. Initially, it is contemplated that the invention will be especially well suited for use with fresh red meat products initially packaged at a central processing facility and subsequently shipped to retail outlets for purchase by consumers. However, the invention is well suited for use with any other food product susceptible to discoloration or spoilage upon exposure to ambient air. Food product 22 is placed within receptacle cavity 20 in any conventional manner.

Each side wall 16 has a laterally extending sealing flange 24 at its upper end. Similarly, each end wall 18 has a laterally extending sealing flange 26 at its upper end. Sealing flanges 24, 26 are interconnected with each other to define a peripheral sealing surface to which film 14 is sealed in a conventional manner, such as by heat sealing, to maintain a desired atmosphere within receptacle cavity 20.

Figure 2:
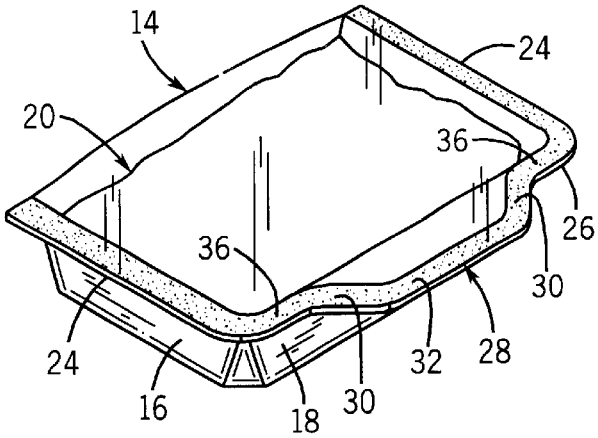
FIG. 2 is a partial isometric view showing the package of FIG. 1 in its original configuration showing the tab extending outwardly from the upper end of one of the receptacle side walls.
Figure 4:
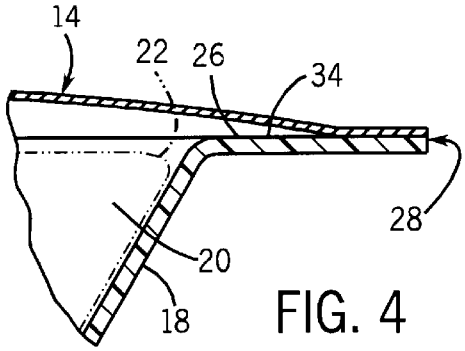
FIG. 4 is a partial section view taken along line 4—4 of FIG. 3.
Figure 3:
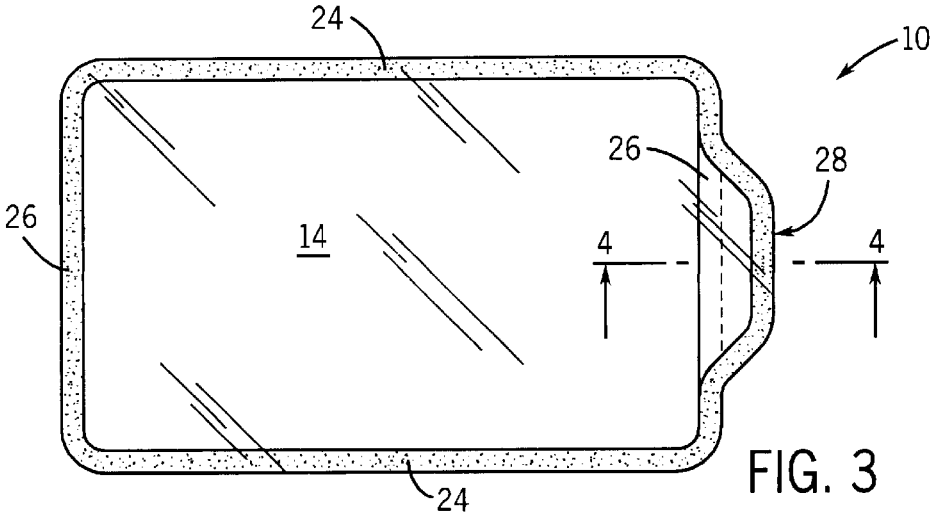
FIG. 3 is a top plan view of the package of FIG. 2 showing the receptacle in its initial configuration.

Package 10 as illustrated in FIGS. 1 and 9 is suitable for display at a retail establishment for purchase by a consumer. FIGS. 2–4 illustrate the original configuration of package 10, and FIGS. 5–8 illustrate the steps involved in processing package 10 to achieve the final configuration of package 10 as shown in FIGS. 1 and 9 from the original package configuration as shown in FIGS. 2–4.

Package 10 as illustrated in FIGS. 2–4 will typically be produced at a central processing facility for subsequent distribution to retail outlets. In its original configuration of FIGS. 2–4, package 10 includes a tab 28 which extends laterally outwardly from sealing flange 26 of one of end walls 18. Tab 28 is in the form of an extension of sealing flange 26 having a length less than the overall length of sealing flange 26. Tab 28 may assume any configuration, and the illustrated embodiment tab 28 is generally trapezoidal in configuration.

As shown in FIGS. 2–4, film 14 is sealed to sealing flanges 24 of side walls 16, and is also sealed to sealing flange 26 of side wall 18 on either side of tab 28. At tab 28, film 14 is sealed at a pair of angled side areas, shown at 30, and an outer end area shown at 32. Tab 28 has a width greater than the width of seal outer end area 32, and film 14 is sealed to the outer area of tab 28. An inner area of tab 28, shown in FIG. 4 at 34, is not sealed to film 14. Unsealed inner area 34 of tab 28 is located between the outer end portion of seal 32 and the portion of sealing flange 26 from which tab 28 extends. As can thus be appreciated, the seal between film 14 and receptacle 12 includes a pair of spaced end portions 36 at which film 14 is sealed to sealing flange 26, and a non-linear segment defined by angled seal side portions 30 and outer end portion 32 disposed therebetween.

The package configuration of FIGS. 2–4 provides a peripheral gas impermeable seal between receptacle 12 and film 14. Preferably, an inert gas atmosphere is contained within receptacle cavity 20 so as to retard or prevent deterioration of food product 22 subsequent to initial packaging at the central processing facility during shipment of package 10 to a retail establishment.

The steps illustrated in FIGS. 5–8 are carried out in preparation for display of package 10 at a retail establishment, such as a grocery store, meat market or the like, in order to replace the inert gas atmosphere contained within receptacle cavity 20 with an oxygen-containing atmosphere.

As shown in FIG. 5, tab 28 is removed from package 10 by severing tab 28 from sealing flange 26 so as to form a linear edge to sealing flange 26 identical to that of sealing flange 26 opposite the sealing flange from which tab 28 extends. The area of film 14 sealed to tab 28 and overlying unsealed area 34 is also removed at the same time tab 28 is removed. Upon removal of tab 28 and the film 14 overlying tab 28, an opening is formed between film 14 and receptacle 12. This opening is in the form of an unsealed area 38 (FIGS. 5, 7) between film 14 and sealing flange 26, which is located between the spaced seal portions 36 at which film 14 is sealed to sealing flange 26.

Subsequent to forming opening 38 by removal of tab 28 and film 14 secured thereto, film 14 at opening 38 is lifted upwardly from sealing flange 26 as shown at FIG. 7 utilizing a suction source 40. Film 14 is stretchable and resilient, which enables film 14 to be stretched slightly to accommodate such upward lifting movement of film 14 at opening 38. An atmosphere exchange nozzle 42 is then inserted through opening 38 such that an inner portion of nozzle 42 is disposed inwardly of opening 38 and overlying food product 22 within receptacle cavity 20. Nozzle 42 includes a discharge 44 at its outer end and a passage 46 in communication with discharge 44. After nozzle 42 is inserted through opening such that discharge 44 is disposed inwardly of opening 38, an oxygen-containing gas is supplied through passage 46 and discharged from discharge 44 into receptacle cavity 20. This discharge of oxygen-containing gas through nozzle discharge 44 functions to replace the inert gas atmosphere within receptacle cavity 20, to produce the desired oxygen bloom on the surface of a fresh red meat food product 22. While the oxygen-containing gas is being discharged into receptacle cavity 20, the inert gas atmosphere is forced out of receptacle cavity 20 through the portion of opening 38 which is unoccupied by nozzle 42. Essentially, the portion of opening 38 unoccupied by nozzle 42 forms an exhaust or discharge passage which enables the inert gas atmosphere to escape receptacle cavity 20 upon introduction of the oxygen-containing gas into receptacle cavity 20 through nozzle discharge 44.

After the atmosphere within receptacle cavity 20 has been exchanged, nozzle 42 is withdrawn from opening 38 and film 14 returns to its unstretched condition such that the portion of film 14 overlying opening 38 is in close proximity to the upper surface of sealing flange 26. Opening 38 is then closed by sealing film 14 to sealing flange 26, such as by utilization of a heat source 48 (FIG. 8). This closure of opening 38 forms a continuous seal of film 14 to sealing flange 26, such that the seal at opening 38 is continuous with spaced seal end portions 36. Heat source 48 is preferably configured so as to overlie the entirety of opening 38 and the ends of seal end portions 36 adjacent thereto, to ensure that a continuous air-tight seal is formed between film 14 and sealing flange 26 throughout the length of sealing flange 26.

The atmosphere exchange method of the invention has been shown and described with reference to introducing the oxygen-containing atmosphere into receptacle cavity 20 using nozzle 42. As an alternative, it is also contemplated that nozzle 42 can be eliminated and oxygen-containing air introduced into receptacle cavity 20 through opening 38 simply by blowing the oxygen-containing atmosphere into receptacle cavity 20 while film 14 is held in its position of FIG. 7 to maintain opening 38 in its open position. It is contemplated that introducing oxygen through opening 38 under pressure will introduce a sufficient amount of oxygen into receptacle cavity 28 to induce the oxygen bloom in food product 22. The pressurized stream of oxygen-containing atmosphere occupies less than the entire area of opening 38, thus enabling inert gas to escape receptacle cavity 20 while the oxygen-containing atmosphere is introduced through opening 38.

In addition, it is contemplated that, if nozzle 42 is used to introduce the oxygen-containing atmosphere into receptacle cavity 20, the length of nozzle 42 extending into receptacle cavity 20 may vary from that shown in the drawing figures. For instance, nozzle 42 may only be inserted such that its discharge 44 overlies sealing flange 26 or extends slightly past sealing flange 26 into receptacle cavity 20, thus eliminating passage of nozzle 42 over food product 22 and avoiding contact therebetween.

As shown in FIGS. 1 and 9, the final configuration of package 10 after resealing of film 14 to close opening 38 is such that the steps carried out in the atmosphere exchange process are undetectable by the consumer simply by viewing package 10 upon display. Package 10 has the same construction as prior art packages in which perishable food products such as fresh meat are typically displayed, resulting in a high degree of consumer acceptance for such products. Production and distribution of such products from a central processing facility is thus greatly facilitated without any adverse impact on the acceptability of such products from a consumer standpoint. The retail establishment operator simply carries out the steps illustrated in FIGS. 5–8, preferably by utilization of automated equipment designed to carry out such steps.

FIGS. 10–18 illustrate a gas atmosphere modification apparatus 10 for use in removing tab 28 and the portion of film 14 sealed thereto, and for injecting oxygen-containing gas into the interior of package 10 and subsequently sealing film 14 to receptacle 12 at unsealed area 38.

Figure 10:
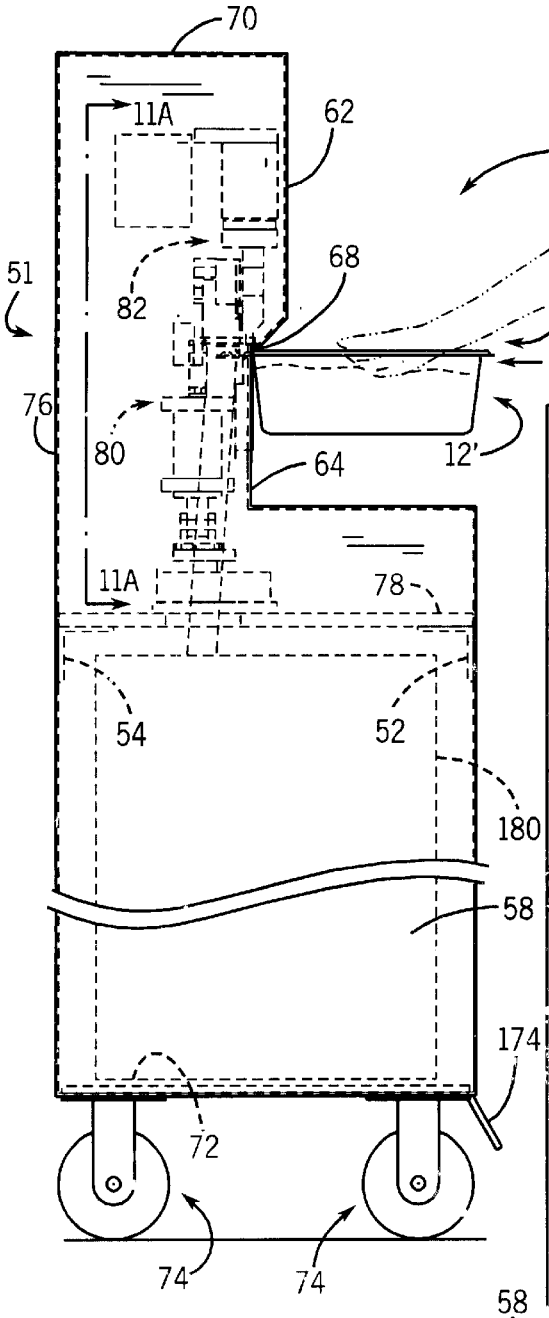
FIG. 10 is a side elevation view of a gas atmosphere exchange or modification apparatus constructed according to the invention, for use in the packaging system of the invention.
Figure 11:
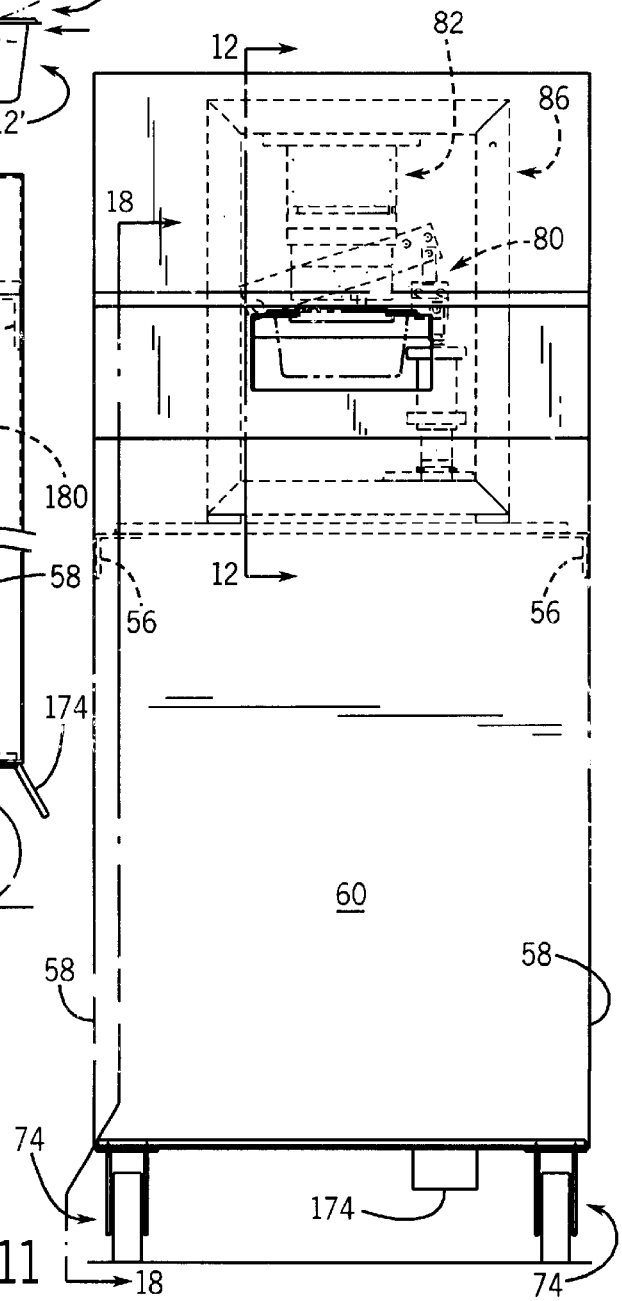
FIG. 11 is a front elevation view of the gas atmosphere modification apparatus of FIG. 10.

Gas atmosphere modification apparatus 50 includes a cabinet 51 having a frame and a series of walls mounted to the frame. As shown in FIGS. 10 and 11, the cabinet frame of apparatus 50 includes a series of horizontal frame members and a series of vertical frame members, in a manner as is known, together with a front cross-member 52, a rear cross-member 54 and a pair of side members 56. Cabinet 51 of apparatus 50 further includes a pair of side walls such as 58, a lower front wall 60, an upper front wall 62 and an intermediate front wall 64. A downwardly facing angled front wall 66 extends between the lower end of upper front wall 62 and the upper end of intermediate front wall 64. A slot 68 is formed at the intersection of angled front wall 66 and intermediate front wall 64, and the length of slot 68 is slightly greater than the overall length of tab 28 to be separated from receptacle 12. Cabinet 51 further includes a top wall 70 and a bottom wall 72, and a series of casters 74 extending downwardly from bottom wall 72 of cabinet 51. Cabinet 51 further includes a rear wall 76, which is preferably hinged and provided with a conventional latch mechanism for movement between an open position providing access to the interior of cabinet 51 and a closed position preventing such access.

A support plate 78 is located within the interior of apparatus 50, and is supported by front and rear cross-members 52, 54, respectively, and side members 56. Support plate 78 functions to divide the interior of cabinet 51 into an upper compartment and a lower compartment.

Figures 12, 12B:
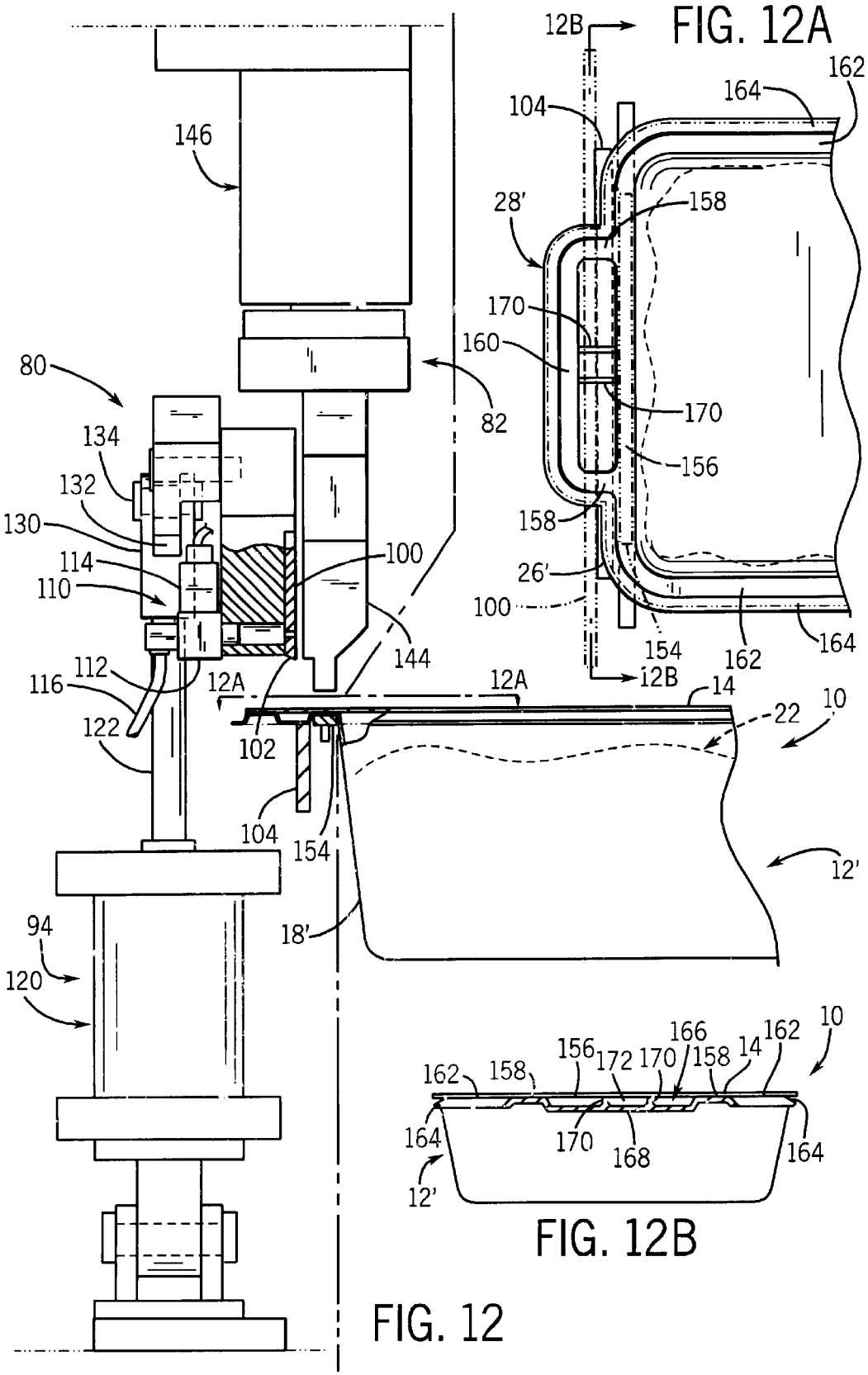
FIG. 12 is a partial section view taken along line 12—12 of FIG. 11.
FIG. 12B is a section view taken along line 12B—12B of FIG. 12A.
Figure 13:
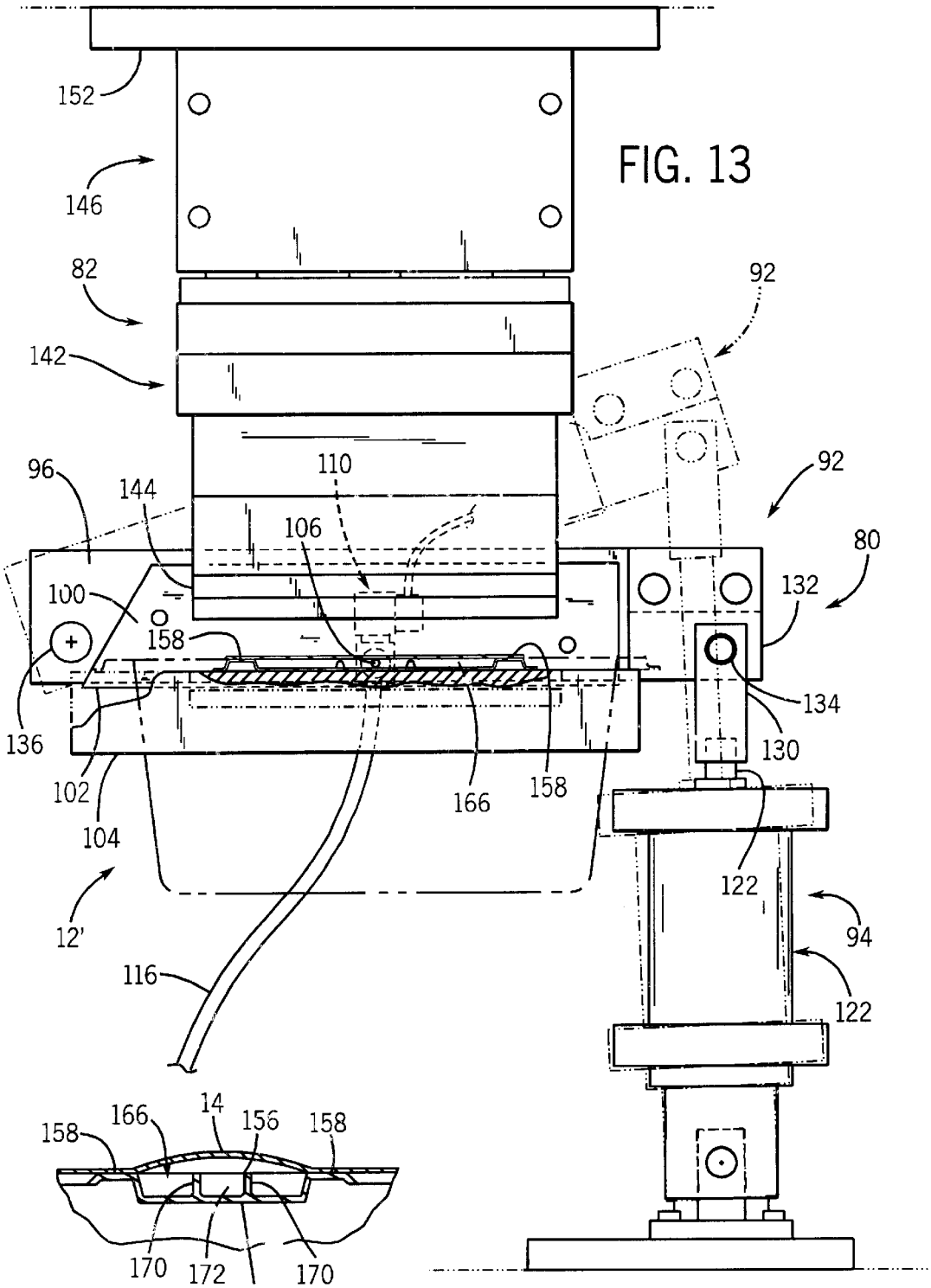
FIG. 13 is a front elevation view of the internal components of the gas atmosphere modification apparatus of FIGS. 10–12, with reference to line 13—13 of FIG. 14.
Figure 15A:
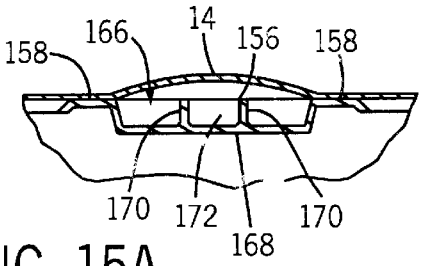
FIG. 15A is a partial section view taken along line 15A—15A of FIG. 15.
Figure 14:
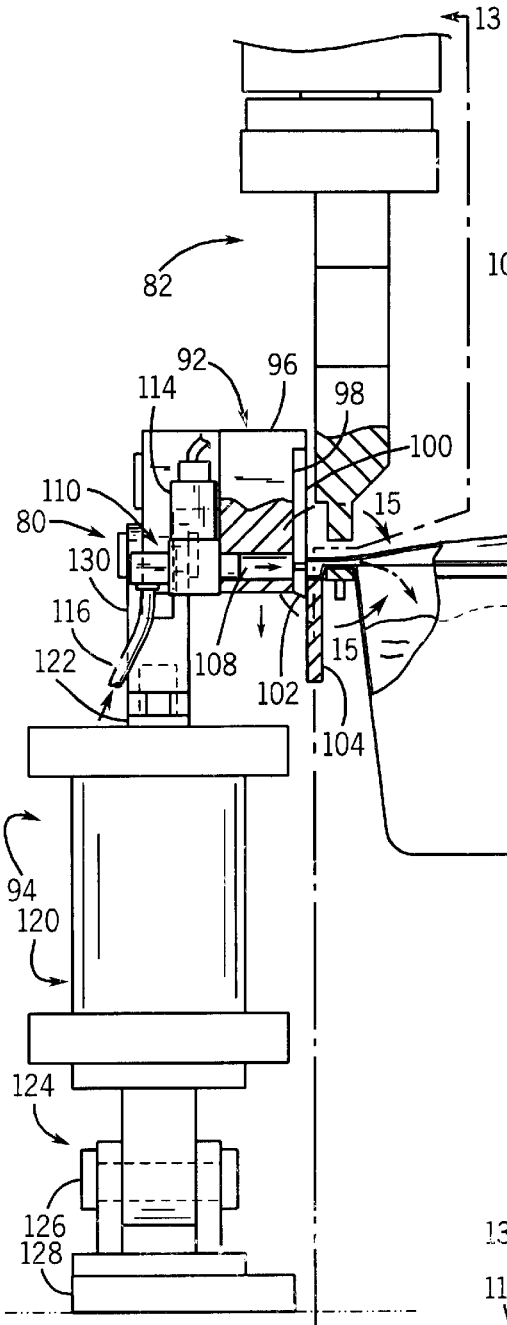
FIG. 14 is a view similar to FIG. 12, showing the components of the gas atmosphere modification apparatus in modifying the gas atmosphere within the package.

With reference to FIGS. 12–14, the upper compartment of cabinet 51 houses the working components of apparatus 50, including a severing mechanism 80 and a sealing mechanism 82. As shown in FIG. 14A, severing mechanism 80 and sealing mechanism 82 are mounted to a frame assembly 84, including a pair of upright frame members 86, an upper frame member 88 and a lower frame member 90 removably fixed to support plate 78.

As shown in FIGS. 12–14, severing mechanism 80 includes a knife member and an extendible and retractable air cylinder assembly 94. Knife member 92 includes a knife support member 96 defining a front face 98 to which a knife blade 100 is mounted. Knife blade 100 defines a downwardly facing sharpened edge 102, and is movable toward and away from a support bar 104 by operation of air cylinder assembly 94. A gas injection port or orifice 106 is formed in knife blade 100, and a passage 108 is formed in knife support member 96 rearwardly of gas injection port 106. A valve assembly 110 is mounted to the rear of knife support member 96, and includes a valve 112 and an actuator 114. Pressurized gas, such as oxygen, is supplied to valve 112 by a flexible tube 116, which is connected at one end to valve 112 and at an opposite end to an oxygen tank 118 (FIG. 18) contained within the lower compartment of cabinet 51. Valve assembly 110 is a conventional valve for intermittently supplying oxygen under pressure from tube 116 to passage 108 in response to a signal received from a controller.

Cylinder assembly 94 of severing mechanism 80 includes a cylinder body 120 and an extendible and retractable rod 122 interconnected with a piston disposed within body 120, in accordance with conventional construction. Body 120 is pivotably mounted via a pivot bracket arrangement 124 and a pivot pin 126 to a mounting plate 128, which in turn is secured to lower frame member 90 of frame assembly 84, as shown in FIG. 14A.

A clevis member 130 is mounted to the upper end of rod 122, and defines a recess within which a mounting plate 132 is received. Mounting plate 132, in turn, is fixed to knife support member 96. A pivot pin 134 is interconnected between clevis member 130 and mounting plate 132 for providing pivoting movement of knife member 92 relative to air cylinder assembly 94. At its end opposite air cylinder assembly 94, knife member 92 is pivotably mounted to a pivot pin 136, which in turn is engaged with a mounting block 138 (FIG. 14A) fixed to upright frame member 86 of frame assembly 84, for providing pivoting movement of knife member 92 relative to frame assembly 84. As shown in FIG. 13, knife member 92 is movable between an inoperative, retracted, raised position, as shown in phantom, upon extension of rod 122 relative to cylinder body 120, in accordance with conventional operation of cylinder assembly 94. Upon retraction of rod 122, knife member 92 is moved downwardly to an operative, severing position shown in solid lines in FIG. 13. Upon such downward movement of knife member 92, lower sharpened edge 102 of knife blade 100 is moved downwardly and across the upper edge of support bar 104, so as to cooperate with support bar 104 in a shear-type severing motion.

Sealing mechanism 82 includes a conventional heat sealing assembly 142 having a heated seal bar 144. Heat sealing assembly 142 is mounted to a pneumatic cylinder assembly 146, which includes a body 148 and a rod 150, in accordance with conventional construction. Pneumatic cylinder assembly 146 in turn is mounted at its upper end to a mounting plate 152, which is fixed to upper frame member 88 of frame assembly 84 as shown in FIG. 14A.

Figure 15:
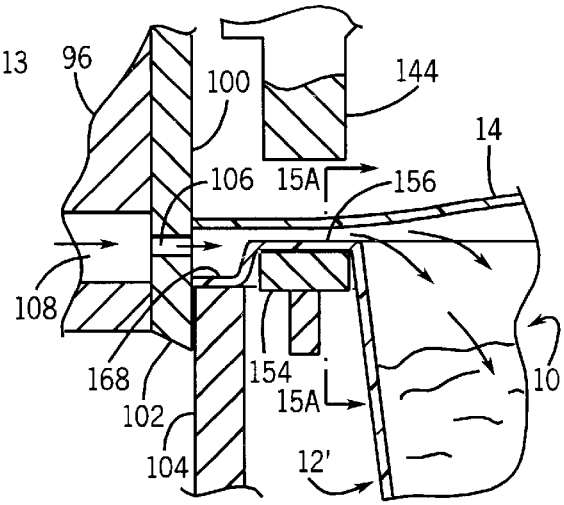
FIG. 15 is an enlarged partial section view with reference to line 15—15 of FIG. 14.
Figure 16:
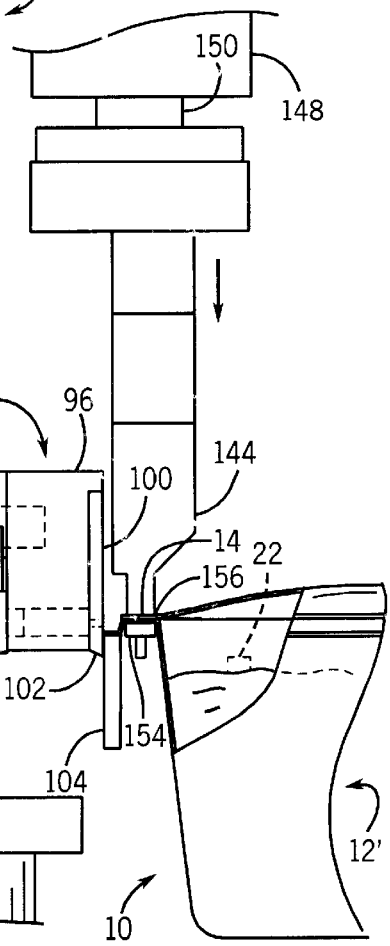
FIG. 16 is a partial side elevation view similar to FIGS. 12 and 14, showing operation of the gas atmosphere modification apparatus in sealing the film to the receptacle sealing area after modification of the gas atmosphere within the package.

In accordance with conventional operation of pneumatic cylinder assembly 146, heat sealing assembly 142 and seal bar 144 are movable downwardly to a sealing position upon extension of rod 150 relative to body 148, as shown in FIG. 16, and upwardly to a retracted position upon retraction of rod 150 relative to body 148, as shown in FIGS. 12–15. As shown in FIGS. 12–16, a sealing anvil 154 is located below seal bar 144 and in vertical alignment therewith, for cooperating with seal bar 144 to seal film 14 to the receptacle, in a manner to be explained.

Referring to FIGS. 12, 12*a*, 12*b* and 15, package 10 incorporates a receptacle 12', which has a somewhat different configuration than receptacle 12 as shown and described with respect to FIGS. 1–9. Receptacle 12' includes an end wall 18' as well as a sealing flange 26' at the upper end of end wall 18', and a tab 28' extends outwardly from sealing flange 26'. A final sealing surface 156 is defined by sealing flange 26', and a pair of spaced axial initial sealing surfaces 158 extend outwardly from final sealing surface 156. A transverse initial sealing surface 160 extends between and interconnects axial initial sealing surfaces 158. Final sealing surface 156, axial initial sealing surfaces 158 and transverse initial sealing surface 160 lie in a common plane, which is coincident with the sealing surfaces defined by the remainder of receptacle 12', shown at 162. A peripheral lip 164 is located outwardly of sealing surfaces 162, extending downwardly and outwardly from sealing surfaces 162. Lip 164 is continuous about the periphery of package 10, and extends outwardly of initial sealing surfaces 158 and 160 as defined by tab 28'.

A recess 166 is located between transverse initial sealing surface 160 and final sealing surface 156. Recess 166 is defined by a lower wall 168, and a pair of ribs 170 extend into recess 166 upwardly from lower wall 168. Ribs 170 extend between transverse initial sealing surface 160 and final sealing surface 156, and cooperate to define a channel 172 centrally located within recess 166.

In a similar manner as explained above with respect to FIGS. 1–9, an initial seal of film 14 to receptacle 12' is formed between film 14 and sealing surfaces 162. Sealing surfaces 162 extend to axial initial sealing surfaces 158, and film 14 is initially sealed to axial initial sealing surfaces 158 and to transverse initial sealing surface 160. In this manner, film 14 is initially sealed to initial sealing surfaces 158 and 160, as well as to sealing surfaces 162, to completely enclose package 10. As noted above, an inert gas atmosphere, such as a nitrogen atmosphere, may be initially contained within package 10 when enclosed in this manner, to preserve food product 22 contained within package 10.

In operation, gas atmosphere modification apparatus 50 functions as follows to replace the atmosphere initially contained in the interior of package 10 with an oxygen-containing atmosphere in order to prepare the food product 22 for display and sale.

Package 10 is positioned relative to apparatus 50 such that the inner portion of tab 28' of package 10 is inserted into slot 68 defined by cabinet 51, such that package 10 is positioned as shown in FIGS. 10 and 12. In this position, anvil 154 is located below final sealing surface 156, and support bar 104 is located below and engaged with recess wall 168 defined by tab 28'. Transverse initial sealing surface 160 of tab 28' is located inwardly of support bar 104, as are the outer portions of axial initial sealing surfaces 158. Once package 10 is positioned relative to apparatus 50 in this manner, operation of apparatus 50 is commenced so as to exchange the atmosphere within the interior of package 10. Referring to FIGS. 10 and 11, an actuator foot pedal 174 is mounted to cabinet 51 for initiating operation of severing mechanism 80 and sealing mechanism 82. It is understood, however, that any other actuating mechanism than foot pedal 174 may be employed, such as a photoeye or the like which detects when package 10 is properly positioned relative to apparatus 50 in the manner as illustrated in FIGS. 10 and 12.

Figure 17A:
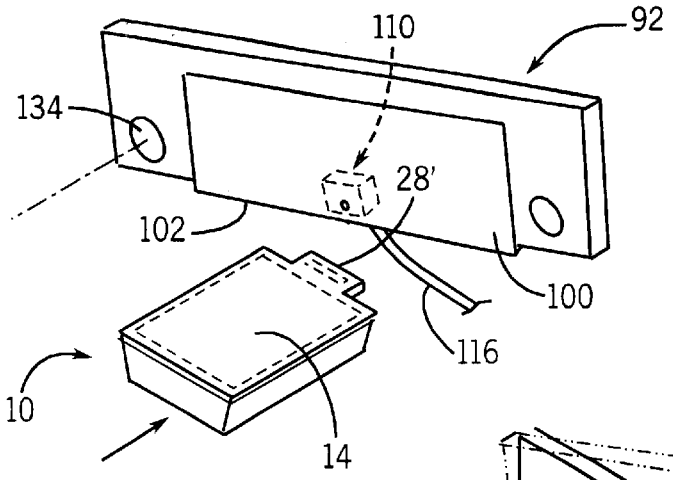
FIGS. 17A–17D are schematic views illustrating the steps carried out by the gas atmosphere modification apparatus of FIG. 10.
Figure 17B:
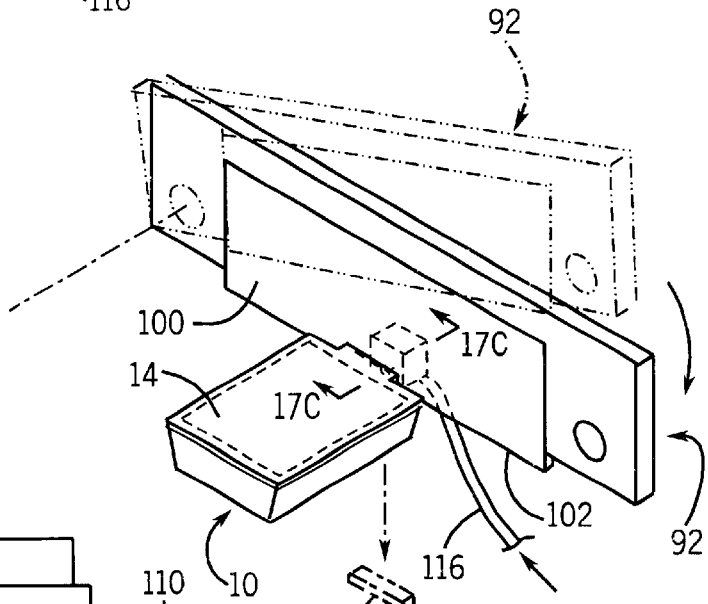
Figure 17C:
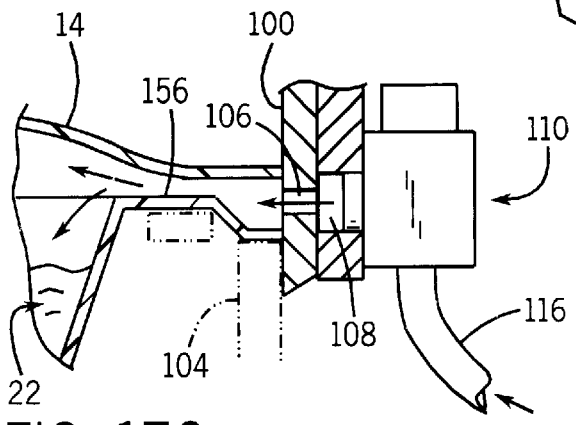
Figure 17D:
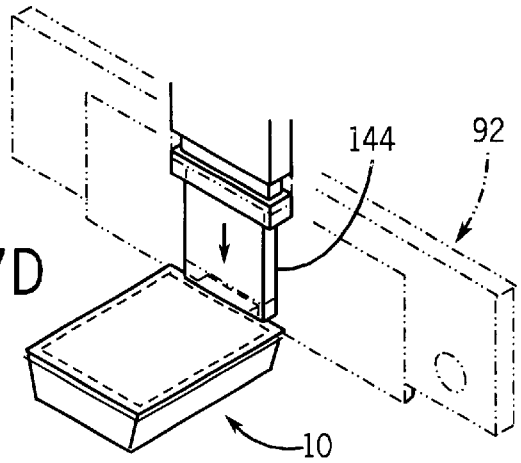

Upon actuation, severing mechanism 80 is first operated such that air cylinder assembly 94 is moved from its raised, retracted position to its lowered, severing position, as shown in FIG. 13. This movement of severing mechanism 80 functions to draw lower cutting edge 102 of knife blade 100 across support bar 104, which functions to sever or shear tab 28' and the portion of film 14 sealed thereto from the remainder of receptacle 12' and film 14, as shown in FIGS. 17*a* and 17*b*. When tab 28' is severed in this manner, the unsealed space between film 14 and final sealing surface 156 forms a passage into the interior of package 10. The width of the passage is the width of final sealing surface 156, due to sealing of film 14 to sealing surfaces 162 outwardly of axial initial sealing surfaces 158. When knife member 92 is moved to its severing position in this manner by operation of air cylinder assembly 94, gas injection port 106 in knife blade 100 is positioned between film 14 and recess wall 168, and between ribs 170 so as to be in communication with channel 172. Ribs 170 function to maintain a space between film 14 and wall 168 at channel 172 when tab 28' is severed by operation of knife member 92.

With knife member 92 maintained in its severing position of FIGS. 13–15, actuator 114 of valve 112 is operated so as to open valve 112 and to supply pressurized oxygen from tank 118 to passage 108 in knife support member 96. This supply of pressurized oxygen to passage 108 functions to discharge oxygen through gas injection port 106 in knife blade 100, and pressurized oxygen discharged from gas injection port 106 is routed through channel 172 into the space between film 14 and final sealing surface 156, and thereby into the interior of package 10. Upon the introduction of the pressurized stream of oxygen into the central area of the opening between film 14 and final sealing area 156 and passage of pressurized oxygen into the interior of package 10, the atmosphere originally contained within the interior of package 10, such as nitrogen gas, is exhausted from the interior of package 10 through the open areas on either side of the central unsealed area between film 14 and final sealing surface 156. Such exhausted gas is then discharged from between the front face of knife blade 100 and the ends of film 14 and recess wall 168. Relief recesses may be formed in the front face of knife blade 100 in the vicinity of recess 166 outwardly of channel 172, to accommodate discharge of gas through the area of recess 166 outwardly of channel 172 when pressurized oxygen is supplied to the interior of package 10 through channel 172.

The supply of pressurized oxygen from gas injection port 106 is continued for a predetermined time period known to supply a sufficient amount of oxygen into the interior of package 10 to replace substantially all of the inert gas atmosphere originally contained within the package interior. The supply of oxygen is then continued for a short additional time period to ensure complete exhaustion of all inert gas from the package interior. The introduction of pressurized oxygen into the package interior functions to pressurize the interior of package 10 about food product 22, which creates a slight "ballooning" of film 14 above receptacle 12'. That is, the portions of film 14 located inwardly of the sealed edges of film 14 are stretched slightly outwardly in response to an increase in pressure within the interior of package 10 above atmospheric pressure.

While the supply of pressurized oxygen is continued through gas injection port 106, cylinder assembly 146 of sealing mechanism 82 is operated so as to extend rod 150 and to bring the lower sealing surface of seal bar 144 into contact with film 14 above final sealing surface 156. Seal bar 144 has a length greater than final sealing surface 156, and is oriented so as to overlap the areas of film 14 sealed to sealing surface 162 on either side of final sealing area 156. The heat of seal bar 144 functions to bond film 14 in a conventional manner to final sealing surface 156, and anvil 154 enables seal bar 144 to be applied with sufficient pressure to ensure that a complete seal of film 14 to final sealing surface 156 is formed. This sealing of film 14 to final sealing surface 156 completes the seal of film 14 to receptacle 12' about the entire periphery of receptacle 12'. In this manner, the inert gas atmosphere originally contained within the interior of package 10 is replaced with a primarily oxygen atmosphere due to the introduction of oxygen through gas injection port 106 under pressure, and the resulting exhaustion of the inert gas atmosphere, all of which is carried out within the open area between film 14 and final sealing surface 156.

Since seal bar 144 is operated to create a seal between film 14 and final sealing surface 156 during continued introduction of pressurized oxygen into the interior of package 10 through gas injection port 106, the seal between film 14 and final sealing area 156 is created while the interior of package 10 is under pressure. This ensures that the oxygen rich gas atmosphere contained within the interior of package 10 permeates the surface of food product 22, to provide an even and consistent oxygen bloom on the surface of food product 22. In addition, the "ballooning" of film 14 ensures that, when packages 10 are stacked one on top of another, the pressure within the interior of a lower package 10 prevents an upper package 10 from moving the film 14 of the lower package 10 downwardly into contact with the upper surface of food product 22 contained within the lower package 10.

With tab 28' removed and film 14 sealed to final sealing surface 156, package 10 has an outward appearance which provides virtually no indication that any gas exchange process has been carried out within the interior of package 10. As can be appreciated, the atmosphere exchange process is carried out without introduction of anything into the package interior other than oxygen gas, which ensures that no contaminants are introduced into the interior of package 10. This atmosphere exchange system is thus extremely well suited for case-ready fresh meat programs or other applications in which it is desired to provide initial packaging in an inert gas atmosphere and subsequent atmosphere exchange to introduce oxygen or another gas into the package interior in preparation for display and sale.

As shown in FIG. 18, a ramp 176 is located within the interior of cabinet 51, having an upper end below the area where tabs 28' are severed by operation of severing mechanism 80. The severed tabs 28' fall by gravity onto ramp 176, which extends through an opening 178 formed in support plate 78. A bin 180 or other receptacle is located within the lower compartment of cabinet 51, and may be supported by bottom wall 72. The severed tabs 28 and portion of film 14 sealed thereto are collected within bin 180, which is periodically emptied when full. Access to bin 180 is provided by opening rear wall 76 of cabinet 51, which is preferably hinged as noted above so as to selectively provide access to the interior of cabinet 51.

As shown in FIG. 14A, severing mechanism 80 and sealing mechanism 82 are mounted to frame assembly 84, which in turn is secured to support plate 78. When it is desired to service or replace either or both of severing mechanism 80 and sealing mechanism 82, the user simply removes support plate 78 and frame assembly 84 from the cabinet interior as a unit, which provides ease in servicing or replacement of components of severing mechanism 80 and sealing mechanism 82 as required. In addition, if replacement of severing mechanism 80 and sealing mechanism 82 is desired, a replacement assembly including frame assembly 84 with severing mechanism 80 and sealing mechanism 82 mounted thereto, is shipped so that the existing components can simply be changed out with the new components simply by removing the original frame assembly 84 from support plate 78 with severing mechanism 80 and sealing mechanism 82 mounted to frame assembly 84, and replacing it with the new frame assembly 84 with severing mechanism 80 and sealing mechanism 82 mounted thereto. The removed components can then be returned for servicing, rebuilding or replacement.

Operation of severing mechanism 80, sealing mechanism 82 and valve assembly 110 may be controlled by a programmable controller housed within the interior of cabinet 51 and interconnected with cylinder assembly 94, valve assembly 110 and cylinder assembly 146 for controlling operation thereof. In addition, a conventional pneumatic air pressure/vacuum system is housed within the interior of cabinet 51 for supplying pressurized air or vacuum to the components of severing mechanism 80, sealing mechanism 82 and valve assembly 110. Preferably, the operation of severing mechanism 80, sealing mechanism 82 and valve assembly 110 is timed so as to occur in a predetermined sequence and for predetermined time intervals subsequent to actuation utilizing foot pedal 174. Alternatively, it is understood that other control methods may be used to control operation of these components, such as manual control of each component or automated control other than by a programmable controller. In addition, the particular sequence of steps carried out may vary from that shown and described, and operating systems other than pneumatic may be employed to control the components. In other words, it is contemplated that a variety of actuating arrangements and sequence steps may be employed to achieve the same end result as shown and described.

The packaging method and gas atmosphere modification apparatus of the invention as set forth above, and the package used in connection therewith, thus attains the objects as set forth above and provides a simple, efficient solution to shelf life, product discoloration and spoilage problems associated with distributing perishable food products from a central processing facility, and provides an effective system for preparing such products for display at a retail establishment.

The invention has been shown and described in terms of exchanging an inert gas atmosphere within a package with a non-inert gas atmosphere. However, it is understood that the invention can be used in any application in which a first atmosphere (or lack of atmosphere) within the interior of a package is exchanged or replaced with a second atmosphere.

Various alternatives and embodiments are contemplated as being within the scope of the following claims particularly pointing out and distinctly claiming the subject matter regarded as the invention.

I claim:

1. A gas atmosphere modification system for a package including a receptacle defining an interior and having a sealing area, and further including a film sealed to the sealing area for closing the package to maintain a first gas atmosphere within the package interior, comprising:

a severing member for severing a portion of the receptacle sealing area and the film sealed thereto from the remainder of the receptacle sealing area and film, wherein severing of the portion of the receptacle sealing area and the film sealed thereto is operable to form an opening between the film and the remainder of the receptacle sealing area;

a pressurized gas introduction system including a gas injection port, wherein the package is adapted for positioning after operation of the severing member such that the opening is located adjacent the gas injection port, wherein the pressurized gas introduction system is operable to discharge a gas from the gas injection port through the opening into the package interior to modify the atmosphere therewithin, wherein at least a portion of the first gas atmosphere escapes from the package interior through the opening upon passage of gas from the gas injection port through the opening into the package interior to create a second gas atmosphere therewithin; and a sealing member for sealing the film to the receptacle sealing area at the opening to close the package and to maintain the second gas atmosphere within the package interior.

2. The gas atmosphere modification system of claim 1, wherein the severing member comprises a knife member movable relative to a stationary support member adapted to support the receptacle adjacent the sealing area, wherein movement of the knife member relative to the support member is operable to sever a portion of the receptacle sealing area located outwardly of the support member together with the film sealed thereto.

3. The gas atmosphere modification system of claim 2, wherein the gas injection port comprises an opening formed in the knife member.

4. The gas atmosphere modification system of claim 3, wherein the pressurized gas introduction system includes a flexible tube interconnected with a pressurized gas supply at a first end and in communication at a second end with the opening in the knife member.

5. The gas atmosphere modification system of claim 4, wherein the knife member comprises a knife blade mounted to a knife support member, wherein the second end of the flexible tube is secured to the knife support member and wherein the knife support member defines a passage establishing communication between the second end of the flexible tube and the knife blade, wherein the opening formed in the knife member comprises an opening in the knife blade which is in communication with the passage in the knife support member.

6. The gas atmosphere modification system of claim 2, wherein the sealing member comprises a movable seal bar located adjacent the knife member for sealing the film to the receptacle sealing area subsequent to operation of the knife member and the pressurized gas introduction system.

7. The gas atmosphere modification system of claim 6, wherein the severing member, the gas injection port and the sealing member are disposed within a housing defining a passage within which is received a portion of the package including the receptacle sealing area and the film sealed thereto, wherein the knife member is located inwardly within the passage and wherein the sealing member is located outwardly of the knife member within the passage.

8. A gas injection system for use with a package including a receptacle having a sealing area and a film sealed thereto, comprising:

an outwardly opening passage for receiving at least a portion of the package including the sealing area and the film sealed thereto;

a severing member located inwardly within the passage for removing a portion of the receptacle sealing area and the film sealed thereto to expose an opening between the film and the receptacle sealing area;

a gas injector located inwardly within the passage for injecting a gas into the package through the opening; and a sealing member located within the passage outwardly of the severing member, wherein the sealing member is operable to seal the film to the sealing area to close the opening subsequent to injection of gas into the package through the opening.

9. The gas injection system of claim 8, wherein the severing member comprises a movable knife arrangement disposed at an inward location within the passage, and wherein the gas injector is associated with the knife arrangement.

10. The gas injection system of claim 9, wherein the gas injector comprises a gas injection port in the knife arrangement and a pressurized gas supply interconnected with the knife arrangement for supplying pressurized gas to the gas injection port.

11. The gas injection system of claim 10, wherein gas is supplied under pressure to the gas injection port through a flexible tube connected at a first end to a pressurized gas supply and at a second end to the knife arrangement and in communication with the gas injection port.

12. The gas injection system of claim 9, wherein the movable knife arrangement includes a movable knife member which cooperates with a stationary support member to sever a portion of the receptacle sealing area and the film sealed thereto which is located inwardly of the support member within the passage.

13. The gas injection system of claim 12, wherein the sealing member is located adjacent the stationary support member and is movable toward the film and the sealing area subsequent to operation of the gas injector to seal the film to the sealing area of the receptacle.

14. The gas injection system of claim 8, wherein the outwardly opening passage is formed in a housing within which the severing member, the gas injector and the sealing member are located, wherein the housing functions to shield the severing member, the gas injector and the sealing member from a location outwardly of the housing.

15. The gas injection system of claim 14, wherein the severing member and the sealing member are mounted to a support structure which is removable from the housing.

16. The gas injection system of claim 15, wherein the support structure comprises a support frame to which the severing member and the sealing member are movably mounted.

17. An apparatus for introducing a second fluid into the interior of a package which includes a receptacle and a film sealed to the receptacle and containing a first fluid, comprising:

a separating arrangement for removing a portion e receptacle and the film sealed thereto to create an opening therebetween providing access to the interior of the package;

a fluid introduction arrangement for introducing the second fluid into the interior of the package through the opening, wherein the second fluid introduced into the interior of the package displaces at least a portion of the first fluid originally contained within the interior of the package and discharges the first fluid from the interior of the package through the opening simultaneously with introduction of the second fluid into the interior of the package through the opening; and a sealing arrangement for sealing the film to a sealing area defined by the package subsequent to introduction of the second fluid into the interior of the package, to close the opening and to maintain the second fluid within the interior of the package.

18. The apparatus of claim 17, wherein the first fluid comprises a first gas atmosphere contained within the package interior and the second fluid comprises a second gas, wherein the fluid introduction arrangement comprises a gas injection system for injecting the second gas into the package interior through the opening.

19. The apparatus of claim 18, wherein the separating arrangement comprises a movable severing member which functions to sever a portion of the receptacle defining a first sealing area, together with a portion of the film sealed thereto, from the remainder of the receptacle which includes a second sealing area and film overlying the second sealing area, wherein the opening is formed between the second sealing area and the film overlying the second sealing area.

20. The apparatus of claim 19, wherein the sealing arrangement is operable to seal the portion of the film which overlies the second sealing area to the second sealing area subsequent to operation of the gas injection system, to maintain the second gas within the package interior.

21. The apparatus of claim 20, wherein the sealing arrangement comprises a support member for supporting the receptacle at the second sealing area, and a movable sealing member movable toward and away from the support member, wherein movement of the sealing member toward the support member functions to sandwich the second sealing area and the film overlying the second sealing area between the sealing member and the support member, to seal the second sealing area and the film overlying the second sealing area together.

22. The apparatus of claim 19, wherein the gas injection system comprises a gas injection port associated with a knife member forming a part of the severing arrangement.

23. A gas injection system for modifying the atmosphere within the interior of a package, comprising:

separating means for removing at least a portion of the package from an opening providing access to the package interior;

injection means for introducing a gas into the package interior through the opening under pressure, wherein introduction of the gas into the package interior modifies the atmosphere of the package interior; and sealing means for sealing the package together at the opening subsequent to introduction of the gas into the package interior to close the opening and to maintain the modified atmosphere within the package interior.

24. The gas injection system of claim 23, wherein the package includes a receptacle having a sealing area and a film, and wherein the separating means is operable to separate a portion of the package sealing area and the film sealed thereto, and wherein the opening is formed between the film and the remainder of the receptacle sealing area.

25. The gas injection system of claim 24, wherein the separating means comprises a severing arrangement.

26. The gas injection system of claim 25, wherein the receptacle sealing area comprises first and second offset sealing areas, wherein the severing arrangement is operable to sever the first sealing area and the film sealed thereto and wherein the opening is formed between the film and the second sealing area, wherein the sealing means is operable to seal the film to the second sealing area.

27. The gas injection system of claim 26, wherein the first sealing area is formed on a tab portion of the receptacle which extends outwardly from a flange defined by the receptacle, wherein the second sealing area is defined by the flange.

28. The gas injection system of claim 25, wherein the severing arrangement comprises at least one movable severing member which is operable to sever the first sealing area and the film sealed thereto.

29. The gas injection system of claim 28, wherein the injection means comprises a pressurized gas supply system and wherein the severing member includes an injection port formed therein, wherein introduction of the gas into the package interior is carried out by supply of pressurized gas from the pressurized gas supply system through the port and through the opening between the film and the second receptacle sealing area.

30. The gas injection system of claim 29, wherein the severing arrangement further includes a movable knife support member to which the severing member is mounted, wherein the knife support member includes a passage in communication with the injection port formed in the movable severing member and wherein the pressurized gas supply system includes a flexible tube interconnected with the knife support member at the passage for supplying pressurized gas thereto.

31. The gas injection system of claim 28, wherein the gas injection system includes a housing within which the separating means, the injection means and the sealing means are located, wherein the housing includes a passage for receiving a portion of the package including the receptacle sealing area and the film sealed thereto.

32. The gas injection system of claim 31, wherein the housing passage opens outwardly, and wherein the severing arrangement is disposed at an inward location relative to the passage defined by the housing and wherein the sealing means is located outwardly of the severing means between the severing means and the outward opening of the passage.

33. A method of modifying a first gas atmosphere within the interior of a package which includes a receptacle having an inner sealing area and an outer sealing area, and a cover sealed to the outer sealing area and overlying the inner sealing area, comprising the steps of:

removing the outer sealing area and the cover sealed thereto by operating of a separating member to expose an opening between the inner sealing area and the cover so as to provide access to the package interior;

introducing a second gas under pressure into the package interior through the opening by operation of a gas injection system, wherein at least a portion of the first gas atmosphere within the package interior escapes through the opening and wherein the second gas functions to modify the atmosphere within the package interior; and sealing the cover overlying the inner sealing area to the inner sealing area by operation of a sealing member to close the opening and to maintain the modified gas atmosphere within the package interior.

34. The method of claim 33, wherein the step of removing the outer sealing area and the cover sealed thereto is carried out by moving the separating member from a retracted position to a severing position, wherein the separating member includes a severing edge which functions to sever the outer sealing area and the cover sealed thereto from the inner sealing area and the cover overlying the inner sealing area.

35. The method of claim 34, wherein the step of introducing the second gas under pressure into the package interior is carried out by injecting the second gas through an injection port formed in the separating member when the separating member is in its severing position.

36. The method of claim 35, wherein operation of the sealing member is carried out so as to seal the cover overlying the inner sealing area to the inner sealing area when pressure within the package interior caused by introduction of the second gas under pressure into the package interior is above atmospheric pressure, to ensure exposure of product contained within the package interior to the second gas.

37. The method of claim 35, wherein the separating member, the gas injection system and the sealing member are disposed within a housing defining a passage, and including the step of positioning the package relative to the housing such that the inner sealing area and the cover sealed thereto are disposed within the passage defined by the housing, such that the steps of removing the outer sealing area and the cover sealed thereto, introducing the second gas under pressure into the package interior, and sealing the cover overlying the inner sealing area, are carried out within the passage defined by the housing.

38. The method of claim 37, wherein the housing contains a receptacle, and further comprising the step of collecting within the receptacle the removed outer sealing areas and cover sealed thereto from successive packages.

* * * * *

UNITED STATES PATENT AND TRADEMARK OFFICE

CERTIFICATE OF CORRECTION

PATENT NO. : 6,481,185 B1
DATED : November 19, 2002
INVENTOR(S) : Raymond G. Buchko It is certified that error appears in the above-identified patent and that said Letters Patent is hereby corrected as shown below:

Column 16,
Line 21, after "portion" delete "e" and substitute therefore -- of the --.

Signed and Sealed this

Fourth Day of November, 2003

JAMES E. ROGAN
*Director of the United States Patent and Trademark Office*